US011636974B2

(12) United States Patent
Satake et al.

(10) Patent No.: US 11,636,974 B2
(45) Date of Patent: Apr. 25, 2023

(54) WOUND MAGNETIC CORE MANUFACTURING METHOD AND WOUND MAGNETIC CORE

(71) Applicant: Hitachi Metals, Ltd., Tokyo (JP)

(72) Inventors: Hirotaka Satake, Tokyo (JP); Tomoki Ono, Tokyo (JP); Tetsuya Takiyama, Tokyo (JP)

(73) Assignee: HITACHI METALS, LTD., Tokyo (JP)

( * ) Notice: Subject to any disclaimer, the term of this patent is extended or adjusted under 35 U.S.C. 154(b) by 622 days.

(21) Appl. No.: 16/490,563

(22) PCT Filed: Jun. 19, 2018

(86) PCT No.: PCT/JP2018/023228

§ 371 (c)(1),
(2) Date: Sep. 2, 2019

(87) PCT Pub. No.: WO2018/235800

PCT Pub. Date: Dec. 27, 2018

(65) Prior Publication Data

US 2020/0075236 A1 Mar. 5, 2020

(30) Foreign Application Priority Data

Jun. 21, 2017 (JP) ..... JP2017-121209

(51) Int. Cl.

| | |
|---|---|
| ***H01F 41/02*** | (2006.01) |
| ***H01F 27/25*** | (2006.01) |
| *H01F 17/00* | (2006.01) |

(52) U.S. Cl.

CPC ..... *H01F 41/0213* (2013.01); *H01F 27/25* (2013.01); *H01F 17/00* (2013.01); *H01F 2017/0093* (2013.01)

(58) Field of Classification Search

None

See application file for complete search history.

(56) References Cited

FOREIGN PATENT DOCUMENTS

| | | |
|---|---|---|
| EP | 0695812 | 2/1996 |
| JP | S57148561 | 9/1982 |

(Continued)

OTHER PUBLICATIONS

Machine translation of JPS 57-148561A. (Year: 1982).*

(Continued)

*Primary Examiner* — Xiaowei Su

(74) *Attorney, Agent, or Firm* — JCIPRNET

(57) ABSTRACT

A method for manufacturing a non-circular wound magnetic core composed of a nano-crystallized soft magnetic alloy thin strip comprises: a step for acquiring a multilayer body by winding a soft magnetic alloy thin strip; a step for nano-crystallizing the soft magnetic alloy thin strip by inserting a heat treatment inner peripheral jig to the inner peripheral side of the multilayer body, maintaining the multilayer body in a non-circular shape, and subjecting the multilayer body to a heat treatment; and a step for maintaining the nano-crystallized multilayer body in the non-circular shape by using outer and inner peripheral jigs and impregnating resin between the layers of the multilayer body. The resin impregnation inner and outer peripheral jigs are shaped so as to not contact the inner peripheral surface and/or the outer peripheral surface of the multilayer body at a part where the multilayer body has a large degree of curvature.

18 Claims, 9 Drawing Sheets

(56) References Cited

FOREIGN PATENT DOCUMENTS

| | | | |
|---|---|---|---|
| JP | S57193014 | | 11/1982 |
| JP | S60250612 | | 12/1985 |
| JP | S62286214 | | 12/1987 |
| JP | H0296313 | | 4/1990 |
| JP | H06124841 | | 5/1994 |
| JP | H07220941 | | 8/1995 |
| JP | H0897063 | | 4/1996 |
| JP | 2004039710 | | 2/2004 |
| JP | 2004039710 | A * | 2/2004 |
| JP | 2016163018 | | 9/2016 |
| WO | 2008099803 | | 8/2008 |

OTHER PUBLICATIONS

Machine translation of JPH08-97063A. (Year: 1996).*
Machine translation of JP2016-163018A. (Year: 2016).*
Machine translation of JP2004-039710A. (Year: 2004).*
"Office Action of China Counterpart Application", dated Mar. 25, 2021, with English translation thereof, p. 1-p. 12.
Office Action of China Counterpart Application, with English translation thereof, dated Sep. 1, 2020, pp. 1-13.
"International Search Report (Form PCT/ISA/210)" of PCT/JP2018/023228, dated Aug. 14, 2018, with English translation thereof, pp. 1-3.
"Office Action of China Counterpart Application", dated Jul. 27, 2021, with English translation thereof, pp. 1-10.
"Search Report of Europe Counterpart Application", dated Feb. 9, 2021, pp. 1-13.
"Office Action of Europe Counterpart Application, Application No. 18821143.7", dated Feb. 28, 2023, p. 1-p. 10.

* cited by examiner

WOUND MAGNETIC CORE MANUFACTURING METHOD AND WOUND MAGNETIC CORE

CROSS-REFERENCE TO RELATED APPLICATION

This application is a 371 application of International PCT application serial no. PCT/JP2018/023228, filed on Jun. 19, 2018, which claims the priority benefit of Japan application no. 2017-121209, filed on Jun. 21, 2017. The entirety of each of the above-mentioned patent applications is hereby incorporated by reference herein and made a part of this specification.

TECHNICAL FIELD

The present invention relates to a method for manufacturing a non-circular wound magnetic core composed of a nano-crystallized soft magnetic alloy thin strip with resin impregnated between layers and the wound magnetic core.

BACKGROUND ART

While it is possible to improve current and voltage control ability and to curb noise and vibration by an increase in the frequency of an inverter that accompanies an improvement in performance of a power semiconductor device, there are problems such as a high-frequency leaking current due to a common mode voltage that is generated by the inverter.

A common mode choke coil has been used as a way of curbing such problems, and an alloy magnetic material such as an amorphous alloy or a nano-crystallized soft magnetic alloy has been used as a magnetic core used therein.

In a case in which an amorphous alloy or a nano-crystallized soft magnetic alloy is used for the magnetic core, in general, the alloy is manufactured as a soft magnetic alloy thin strip by a single roll method or the like, the thin strip is wound in a layered form, and the wound thin strip is used as a wound magnetic core.

It is important to reliably establish insulation between layers in order to improve magnetic properties for the wound magnetic core. As a simple method for establishing insulation between the layers, there is a means of loosely winding the thin strip such that an air gap is generated between the wound thin strip layers when the thin strip is wound to obtain a wound magnetic core. However, if the thin strip is left with the air gap therebetween, the thin strip is easily deformed by external stress during utilization of the wound magnetic core, adjacent thin strip layers may be brought into contact with each other, and this may thus make it impossible to secure the insulation between the layers. In particular, since the nano-crystallized soft magnetic alloy thin strip is brittle, the thin strip may be deformed, partial contact may thus occur between the layers, and this may make it difficult to maintain the insulation, or there may also be a case in which the thin strip breaks due to the brittleness thereof.

Therefore, the thin strip may be used in a state in which the insulation between the layers is secured in the wound magnetic core by impregnating a resin between the thin strip layers, as disclosed in Patent Literatures 1 and 2, for example.

In addition, the wound magnetic core may be formed into a non-circular shape such as a rectangular shape, a race track shape, or an oval shape for reasons such as facilitating a coil winding operation. For example, Patent Literature 3 discloses that a square magnetic core is obtained by winding a soft magnetic alloy thin strip around a first inner peripheral jig with an oval shape, then removing the inner peripheral jig with the oval shape, and inserting a second inner peripheral jig with a square columnar shape into the hollow portion.

CITATION LIST

Patent Literature

[Patent Literature1]
Japanese Unexamined Patent Laid-Open No. 2004-39710
[Patent Literature 2]
Japanese Unexamined Patent Laid-Open No. 62-286214
[Patent Literature 3]
Japanese Unexamined Patent Laid-Open No. 2016-163018

SUMMARY OF INVENTION

Technical Problem

For the purpose of an electric vehicle or an air conditioner, a wound magnetic core is disposed in a device in which a large number of wirings and electronic components are disposed. Therefore, the wound magnetic core may be designed into a shape that prevents the wound magnetic core from spatially interfering with the wirings and the electronic components. In this case, a required dimensional tolerance is frequently decided at a plurality of locations of a non-circular shape in a micron order.

If the magnetic core is a pressed powder body, the magnetic core is easily manufactured into a near net shape. However, there are not many ways to manufacture a wound magnetic core soft magnetic alloy thin strip that can undergo nano-crystallization into a near net shape other than by forming the thin strip into a desired non-circular shape when the thin strip is wound or by producing a multilayer body wound into a circular shape and deforming the multilayer body into a desired non-circular shape. However, there is a problem of a decrease in inductance for the following reason even if either of these ways is employed.

First, a problem in the manufacturing method of forming a thin strip into a desired non-circular shape when the thin strip is wound will be described. In this manufacturing method, a way of winding the thin strip around a rotating non-circular bobbin is employed. Since the bobbin has a non-circular shape, the distance from a rotation axis to an outer periphery is not uniform, and an outer peripheral portion at which the distance is long has a large rotation radius, a winding speed thereof is high. The thin strip wound at this portion has higher tensile force than the thin strip wound at other portions. At the portion at which the thin strip is wound in a high tensile force state, contact between thin strip layers becomes tight. Therefore, the layers of the thin strip of the wound magnetic core obtained by this manufacturing method are brought into contact with each other, and an eddy current loss of the magnetic core increases.

Also, in a case in which the way of producing a multilayer body of a soft magnetic alloy thin strip wound into a circular shape and then deforming the multilayer body into a non-circular shape is employed, contact between thin strip layers becomes tight at a portion at which a degree of curvature increases due to the deformation similarly to the above case. As a result, contact between the layers similarly occurs, and an eddy current loss of the wound magnetic core increases.

If the eddy current loss increases, a magnetic flux in a magnetic path direction of the magnetic core is prevented in the wound magnetic core for a common mode choke coil. Therefore, impedance properties (inductance) of the wound magnetic core of the wound coil deteriorate.

The inventors of the present invention employed a process for causing a resin to be impregnated between layers of a multilayer body in order to secure insulating properties between layers of a thin strip for manufacturing such a non-circular wound magnetic core, However, there was a problem that the multilayer body with the resin impregnated therein swelled in a lamination direction, and as a result, it became difficult to manufacture a wound magnetic core within a required dimensional tolerance.

Thus, an inner peripheral jig and an outer peripheral jig with shapes that entirely cover an inner peripheral side and an outer peripheral side of the wound multilayer body were produced, and a resin was caused to be impregnated while being maintained with the jigs in the lamination direction. However, a problem that inductance deteriorated is remained.

An object of the invention is to provide a method for manufacturing a non-circular wound magnetic core composed of a nano-crystallized soft magnetic alloy thin strip and the wound magnetic core that easily curb a decrease in inductance due to resin impregnation.

Solution to Problem

According to the invention, there is provided a method for manufacturing a non-circular wound magnetic core composed of a nano-crystallized soft magnetic alloy thin strip, the method including: a step of acquiring a multilayer body by winding a soft magnetic alloy thin strip that can undergo nano-crystallization; a step of nano-crystallizing the soft magnetic alloy thin strip that can undergo nano-crystallization by inserting a heat treatment inner peripheral jig on the inner peripheral side of the multilayer body, maintaining the multilayer body in a non-circular shape when viewed in the axial direction, and subjecting the multilayer body maintained in the non-circular shape to heat treatment; and a step of maintaining the nano-crystallized multilayer body in the non-circular shape using resin impregnation inner peripheral and outer peripheral jigs and impregnating a resin between the layers of the multilayer body, in which the resin impregnation inner peripheral and outer peripheral jigs are shaped so as to not contact at least one of the inner peripheral surface and the outer peripheral surface of the multilayer body at a part where the multilayer body has a large degree of curvature.

More specifically, a manufacturing method that satisfies either one of the following two conditions can be applied.

(1) The resin impregnation inner peripheral jig is shaped to contact the inner peripheral surface of the multilayer body at the part where the multilayer body has the large degree of curvature, and the resin impregnation outer peripheral jig is shaped to contact at least a part of the outer peripheral surface of the multilayer body to maintain the multilayer body in the non-circular shape, but does not contact the outer peripheral surface of the multilayer body at the part where the multilayer body has the large degree of curvature.

(2) The resin impregnation outer peripheral jig is shaped to contact the outer peripheral surface of the multilayer body at the part where the multilayer body has the large degree of curvature, and the resin impregnation inner peripheral jig is shaped to contact at least a part of the inner peripheral surface of the multilayer body to maintain the multilayer body in the non-circular shape, but does not contact the inner peripheral surface of the multilayer body at the part where the multilayer body has the large degree of curvature.

In the step of acquiring the multilayer body by winding the soft magnetic alloy thin strip that can undergo nano-crystallization, the obtained multilayer body preferably has a circular shape when viewed in the axial direction and a space factor of the soft magnetic alloy thin strip is preferably equal to or greater than 70% and equal to or less than 85%.

In addition, the heat treatment inner peripheral jig may be shaped to contact the inner peripheral surface of at least the part where the multilayer body has the large degree of curvature.

In addition, the heat treatment inner peripheral jig may be shaped to maintain the entire periphery of the inner peripheral surface of the multilayer body.

In addition, in the step of nano-crystallizing the soft magnetic alloy thin strip, the multilayer body may also be maintained on the outer peripheral side using the heat treatment outer peripheral jig, and the heat treatment outer peripheral jig may be shaped to maintain at least a part of the outer peripheral surface of the multilayer body in the non-circular shape.

Also, the non-circular shape may be a flat shape.

In addition, the non-circular shape may be a flat shape with at least a part that is recessed inward.

In addition, at the part where the non-circular multilayer body has the large degree of curvature, the degree of curvature may be equal to or greater than 0.02.

Also, the wound magnetic core may be used for a common mode choke coil.

In addition, a wound magnetic core may be manufactured by the aforementioned manufacturing method.

Advantageous Effects of Invention

It is possible to provide a method for manufacturing a non-circular wound magnetic core composed of a nano-crystallized soft magnetic alloy thin strip that facilitates curbing of a decrease in inductance due to resin impregnation. Also, it is thus possible to obtain a wound magnetic core with sufficiently large inductance.

DESCRIPTION OF EMBODIMENTS

Figure 1:
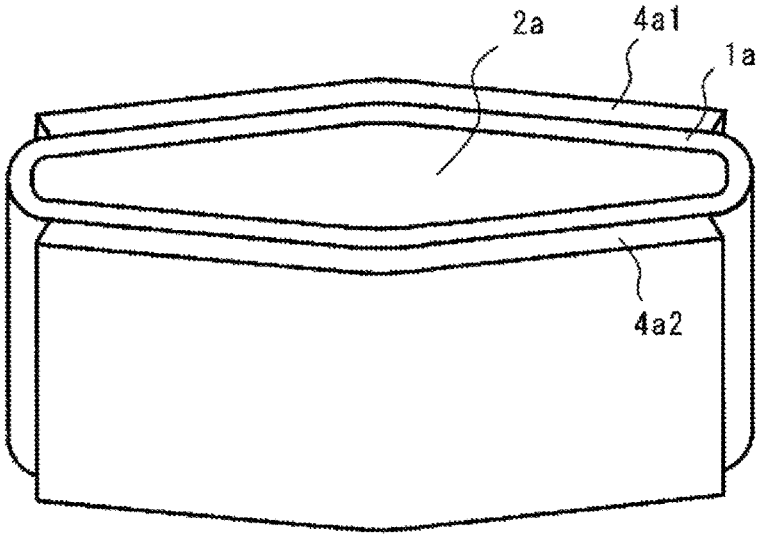
FIG. 1 is a perspective view illustrating an example of a state in which a multilayer body 1*a*, an inner peripheral jig 2*a*, and outer peripheral jigs 4*a*1 and 4*a*2 are combined.

The inventors reviewed the reasons that inductance tends to deteriorate if a resin is impregnated in a non-circular wound magnetic core. Thus, the inventors found that the inductance tends to deteriorate because the thin strip gathers with high density in a lamination direction at a part where a degree of curvature is large, air gaps between layers are small, the resin is not sufficiently impregnated, thin strip layers are brought into contact with each other, and it is thus not possible to sufficiently prevent occurrence of an eddy current loss.

Thus, the inventors conducted the following operation when the resin was impregnated in the multilayer body. First, they maintained a nano-crystallized multilayer body in a non-circular shape in a state in which the multilayer body is pinched with resin impregnation outer peripheral and inner peripheral jigs in the lamination direction in order for the dimension not to deviate from a target range due to swelling of the multilayer body in the lamination direction. However, they used the resin impregnation inner peripheral jig and the outer peripheral jig with shapes such that the inner peripheral jig and the outer peripheral jig do not contact at least either one of an inner peripheral surface or an outer peripheral surface of the multilayer body at a part where a degree of curvature of the multilayer body is large in order for the resin to be sufficiently impregnated at the part where the degree of curvature of the multilayer body is large.

In this manner, the part where the degree of curvature of the multilayer body is large is brought into a state in which the gaps of the thin strip layers tend to expand, and the resin thus tends to be sufficiently impregnated. Also, even if the resin is impregnated at that part, the shape of the part where the degree of curvature is large is substantially maintained due to rigidity of the nano-crystallized soft magnetic alloy thin strip since other parts are maintained in the non-circular shape with the inner peripheral jig and the outer peripheral jig. As a result, it is possible to maintain the non-circular shape state within a requested dimensional error and further to curb a decrease in inductance.

That is, a manufacturing method according to an embodiment of the invention is a method for manufacturing a non-circular wound magnetic core composed of a nano-crystallized soft magnetic alloy thin strip, the method including: a step of acquiring a multilayer body by winding a soft magnetic alloy thin strip that can undergo nano-crystallization; a step of nano-crystallizing the soft magnetic alloy thin strip that can undergo nano-crystallization by inserting a heat treatment inner peripheral jig on the inner peripheral side of the multilayer body, maintaining the multilayer body in a non-circular shape when viewed in the axial direction, and subjecting the multilayer body maintained in the non-circular shape to a heat treatment; and a step of maintaining the nano-crystallized multilayer body in the non-circular shape by using resin impregnation inner peripheral and outer peripheral jigs, and impregnating a resin between the layers of the multilayer body, in which the resin impregnation inner peripheral and outer peripheral jigs are shaped so as to not contact at least one of the inner peripheral surface and the outer peripheral surface of the multilayer body at a part where the multilayer body has a large degree of curvature.

Note that the expression "shaped so as to not contact at least one of the inner peripheral surface and the outer peripheral surface of the multilayer body at a part where the multilayer body has a large degree of curvature" includes a shape in which the jigs are in partial contact with the inner peripheral surface or the outer peripheral surface at the part where the multilayer body has a large degree of curvature. Also, the expression "shaped to contact" does not necessarily indicate a state in which the jigs and the inner peripheral surface or the outer peripheral surface of the multilayer body are in complete contact with each other over the entire part with the degree of curvature, and the jigs and the inner peripheral surface or the outer peripheral surface of the multilayer body may face each other in proximity with a clearance therebetween. In other words, it is only necessary for the shapes of the jigs to be shapes that follow the shape of the part with the degree of curvature of the multilayer body in such a form that deformation of the multilayer body is curbed.

More specifically, a manufacturing method that satisfies either one of the following two conditions can be applied. However, the invention is not limited to these two conditions.

(1) The resin impregnation inner peripheral jig is shaped to contact the inner peripheral surface of the multilayer body at the part where the multilayer body has the large degree of curvature, and the resin impregnation outer peripheral jig is shaped to contact at least a part of the outer peripheral surface of the multilayer body to maintain the multilayer body in the non-circular shape, but does not contact the outer peripheral surface of the multilayer body at the part where the multilayer body has the large degree of curvature.

(2) The resin impregnation outer peripheral jig is shaped to contact the outer peripheral surface of the multilayer body at the part where the multilayer body has the large degree of curvature, and the resin impregnation inner peripheral jig is shaped to contact at least a part of the inner peripheral surface of the multilayer body to maintain the multilayer body in the non-circular shape, but does not contact the inner peripheral surface of the multilayer body at the part where the multilayer body has the large degree of curvature.

In a case in which there are a plurality of parts where the multilayer body has large degrees of curvature, the resin impregnation jigs are further preferably shaped so as to not contact any of the peripheral surfaces of the parts where the degrees of curvature are large at least on the inner peripheral side or the outer peripheral side of the multilayer body.

The invention will be described in more detail below.

A soft magnetic alloy thin strip that can undergo nano-crystallization will be described.

The soft magnetic alloy thin strip that can undergo nano-crystallization is mainly an alloy thin strip in an amorphous state.

As for a composition of the alloy thin strip, an alloy with a composition represented by the formula: $(Fe_{1-a}M_a)_{100-x-y-z-\alpha-\beta-\gamma}Cu_xSi_yB_zM'_\alpha M''_\beta X_\gamma$ (atom %) (where M is Co and/or Ni, M' is at least one element selected from the group consisting of Nb, Mo, Ta, Ti, Zr, Hf, V, Cr, Mn, and W, M' is at least one element selected from the group consisting of Al, an element from the platinum group, Sc, a rear earth element, Zn, Sn, and Re, X is at least one element selected from the group consisting of C, Ge, P, Ga, Sb, In, Be, and As, and a, x, y, z, α, β, and γ satisfy $0 \le a \le 0.5$, $0.1 \le x \le 3$, $0 \le y \le 30$, $0 \le z \le 25$, $5 \le y+z \le 30$, $0 \le \alpha \le 20$, $0 \le \beta \le 20$, and $0 \le \gamma \le 20$).

A soft magnetic alloy thin strip with a long shape that can undergo nano-crystallization can be obtained by melting the alloy with the aforementioned composition at a melting point or higher and rapidly solidifying the alloy by a single roll method. As a method for manufacturing the soft magnetic alloy thin strip, technologies known as methods for manufacturing an amorphous alloy thin strip and a nano-crystallized soft magnetic alloy thin strip can be used.

It is possible to obtain a wound magnetic core with high inductance by using a soft magnetic alloy thin strip with a thickness of equal to or less than 15 μm. In particular, the soft magnetic alloy thin strip with a thickness of equal to or less than 15 μm is useful in a wound magnetic core for a common mode choke coil since impedance in a high-frequency region (equal to or greater than 100 kHz) is easily improved. Note that it is only necessary for the thickness of the soft magnetic alloy thin strip to be equal to or greater than 5 μm and the thickness is further preferably equal to or greater than 7 μm.

Figure 5:
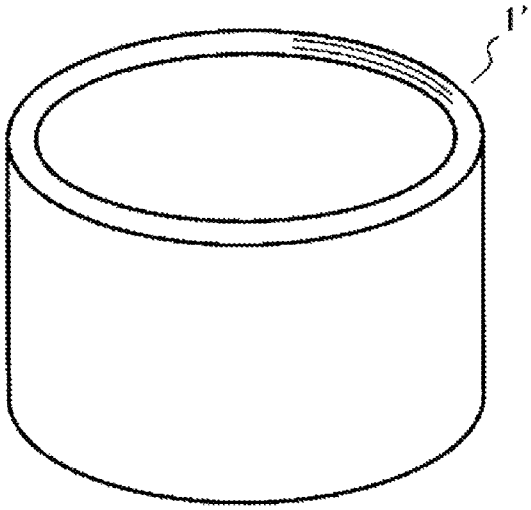
FIG. 5 is a perspective view illustrating an example of a multilayer body 1' in a state in which a soft magnetic alloy thin strip is wound therearound.

The long soft magnetic alloy thin strip obtained by the single roll method or the like is subjected to slit working as needed and is wound around a bobbin with a predetermined shape, thereby obtaining an annular multilayer body 1' illustrated in FIG. 5.

In the process of acquiring the multilayer body, the multilayer body of the soft magnetic alloy thin strip is preferably wound into a circular shape when viewed in an axial direction such that the space factor is equal to or greater than 70% and equal to or less than 85%. An upper limit of the space factor is more preferably 80% and is further preferably 78%. Also, a lower limit of the space factor is more preferably 72%.

The multilayer body 1' obtained by winding the soft magnetic alloy thin strip preferably has a circular shape when viewed in the axial direction. The reason is as follows. In a case in which a non-circular multilayer body 1*a* is obtained, the soft magnetic alloy thin strip is wound around a non-circular bobbin, thereby manufacturing the multilayer body 1*a*. However, distances between the rotation axis and the respective parts of the periphery thereof in the non-circular bobbin differ from each other, and that is, peripheral speeds at the respective parts differ from each other. Therefore, it is not possible to wind out the thin strip from a winding-out roll on a supply side with constant tensile force unless complicated tensile force control is performed. In a case in which the thin strip is wound out under varying tensile force, the distances between the thin strip layers also vary in the wound multilayer body, and the amount of resin filled varies. Therefore, inductance of the wound magnetic core tends to change. Also, the wound-out thin strip tends to break, and it may become difficult to wind the thin strip around the bobbin due to the variation in tensile force.

Next, the space factor will be described. If the space factor is high, it is difficult to establish insulation between layers even in a case in which resin impregnation is performed, and inductance tends to deteriorate. The reason is as follows. In order to obtain more reliable insulation between the layers through the resin impregnation, the resin preferably permeates to the inside of the wound magnetic core. However, the reason for the deterioration of inductance is estimated to be that it becomes difficult to cause the resin to permeate to the inside of the magnetic core if the space factor is excessively high. If the space factor of the soft magnetic alloy thin strip is equal to or less than 85%, the resin is easily caused to permeate to the inside of the wound magnetic core even if the multilayer body is deformed into a non-circular shape, and the insulation between the layers tends to be secured.

Meanwhile, if the space factor is equal to or greater than 70%, high saturation magnetic flux density is easily obtained since an effective sectional area of the wound magnetic core is easily secured in comparison with the same wound magnetic core dimension. Therefore, the excellent magnetic properties that the soft magnetic alloy thin strip originally has are sufficiently utilized.

Note that the space factor in the invention is a proportion Sribon/Stotal of both an entire sectional area (except for a resin adhering to the surface of the wound magnetic core) Stotal when the wound magnetic core is cut along a plane including the winding axis and the cut surface is observed and a sectional area Sribon of the soft magnetic alloy thin strip calculated from both the sectional areas.

Next, a heat treatment process for nano-crystallization will be described.

The soft magnetic alloy thin strip that can undergo nano-crystallization is mainly a thin strip in an amorphous state and obtains a nano-crystallized structure in which equal to or greater than 50% of the composition has an average crystal particle diameter of equal to or less than 100 nm by being subjected to heat treatment at a temperature of equal to or greater than a crystallization start temperature. If the soft magnetic alloy thin strip has the aforementioned composition, the heat treatment for nano-crystallization is typically performed within a range of equal to or greater than 450° C. and equal to or less than 600° C.

However, free deformation cannot occur after the nano-crystallization. This is because, although the thin strip in an amorphous state has elasticity and is recovered even when bent to a degree of curvature to some extent, the thin strip with the nano-crystallized structure has high brittleness. Therefore, the wound multilayer body is deformed into a desired shape before the nano-crystallization, and a heat treatment for nano-crystallization is then performed thereon in a state in which the shape is maintained.

During the nano-crystallization, the multilayer body composed of the thin strip in an amorphous state is maintained in the shape with a heat treatment jig for maintaining the shape. As the heat treatment jig, the inner peripheral jig can be used alone while the outer peripheral jig may also be used.

The heat treatment inner peripheral jig is preferably shaped to contact the inner peripheral surface of at least the part where the multilayer body has a large degree of curvature.

The volume of the soft magnetic alloy thin strip that can undergo nano-crystallization is reduced by several % during the nano-crystallization since the crystal structure changes. Although the part where the degree of curvature is large is easily deformed, the dimension of the multilayer body is easily maintained in a desired shape even after the heat treatment process by using the heat treatment inner peripheral jig that is in contact at least with the inner peripheral surface of that part. Also, since the inner peripheral surface is deformed to shrink as a whole, it is further preferable to use a heat treatment inner peripheral jig with a shape that maintains the entire periphery of the inner peripheral surface of the multilayer body in order to maintain the desired shape.

In addition, it is preferable that, in the process of nano-crystallization, the multilayer body be maintained with the heat treatment inner peripheral jig and a heat treatment outer peripheral jig disposed on the outer peripheral side and that the heat treatment outer peripheral jig be shaped to maintain at least a part of the outer peripheral surface of the multilayer body in the non-circular shape. Also, the heat treatment outer peripheral jig may be shaped to maintain the entire periphery of the outer peripheral surface of the multilayer body.

It becomes easy to maintain the multilayer body in a desired shape even after the heat treatment process by using not only the heat treatment inner peripheral jig but also the outer peripheral jig.

The multilayer body is deformed into a non-circular shape, and it is preferable to apply the invention when the multilayer has a flat shape, in particular, a flat shape in which a ratio between a maximum diameter and a minimum diameter is equal to or greater than 2 or is further preferably equal to or greater than 3. Although a portion with a large degree of curvature tends to be generated as the degree of flatness becomes higher in the annular multilayer body, resin impregnation is sufficiently performed even at the part with the large degree of curvature by applying the invention. If the multilayer body has a flat shape and has a shape with at least a part that is recessed inward, the part with a large degree of curvature is more likely to be formed. Therefore, it is more preferable to apply the present invention.

The manufacturing method according to the invention is preferably applied in a case in which the degree of curvature on the inner peripheral surface side is equal to or greater than 0.02 at the part where the non-circular multilayer body has a large degree of curvature. Further, it is preferable to apply the invention in a case in which the degree of curvature is equal to or greater than 0.03 or is further preferably equal to or greater than 0.05.

Note that the degree of curvature is a reciprocal of a curvature radius R and is represented as 1/R (1/mm). The curvature radius is determined by an outline of the inner peripheral surface when the wound magnetic core is viewed in the axial direction. Even in a case in which the outline of the inner peripheral surface does not have a part with a complete arc shape at the inner peripheral surface, the shape can be approximated to an arc if a sufficiently minute length (the length of 3 mm at the curve portion in the invention) is provided. Also, it is possible to calculate the degree of curvature from the curvature radius R of the approximated arc.

The manufacturing method according to the invention is preferably applied to a wound magnetic core with a height of equal to or greater than 20 mm in the winding axis direction.

Although it is more difficult to sufficiently perform resin impregnation as the wound magnetic core is higher, it becomes easy to inhibit a decrease in inductance by applying the manufacturing method according to the invention. It is further preferable to apply the manufacturing method according to the invention to a wound magnetic core with a height of equal to or greater than 30 mm in the winding axis direction.

The manufacturing method according to the invention is preferably applied to a wound magnetic core with a thickness of equal to or greater than 2 mm in the lamination direction. Although it is more difficult to sufficiently perform resin impregnation as the thickness in the lamination direction is thicker, it becomes easy to inhibit a decrease in inductance by applying the manufacturing method according to the invention. It is further preferable to apply the manufacturing method according to the invention to a wound magnetic core with a thickness of equal to or greater than 3 mm in the lamination direction.

After the process of nano-crystallization, resin impregnation is performed. Note that the resin impregnation is performed for the purpose of securing insulation between the thin strip layers and other purposes include a role of maintaining the shape of the multilayer body and a role of preventing the thin strip from falling off.

The nano-crystallized multilayer body is maintained in the non-circular shape with the resin impregnation inner peripheral jig and the outer peripheral jig in order to prevent deformation in the process of resin impregnation.

The resin impregnation inner peripheral jig and the outer peripheral jig are shaped so as to not contact at least one of the inner peripheral surface and the outer peripheral surface of the multilayer body at the part where the multilayer body has a large degree of curvature.

The reason thereof is as described above.

Note that the expression that the resin impregnation inner peripheral jig and the outer peripheral jig "maintain the multilayer body in the non-circular shape" means that the shape is any shape as long as the amount of deformation of each part of the multilayer body can be curbed to be equal to or less than ±500 μm through the resin impregnation. A shape that enables curbing of the amount of deformation to be equal to or less than ±300 μm, or further preferably equal to or less than ±200 μm is more preferably employed.

In the process of resin impregnation, the resin preferably has viscosity of equal to or greater than 0.3 mPa·s and equal to or less than 10 mPa·s. The resin includes a resin with viscosity adjusted within the aforementioned range by being diluted with a solution such as an organic solvent.

The viscosity of the resin affects how easily the resin enters between the layers. Since the content of the solution in the resin with the viscosity of less than 0.3 mPa·s is excessively high, it is difficult to increase a resin filling rate, which will be described later, after the solution is evaporated even if the resin is sufficiently impregnated between the layers of the multilayer body. Meanwhile, if the viscosity is greater than 10 mPa·s, it is difficult to sufficiently impregnate the resin between the layers. Also, it takes a long time to impregnate the resin, which leads to an increase in manufacturing costs.

An epoxy resin, a polyimide resin, or the like is conceivable as the resin used in the invention, and an epoxy resin is preferably used in terms of heat resistance and temperature properties. Also, it is possible to use a thermosetting resin.

A pressure applied when the resin is impregnated is preferably equal to or greater than −0.05 MPa and equal to or less than 0 MPa with respect to atmospheric pressure. If the pressure is excessively low, the solvent is significantly vaporized. In order to inhibit consumption of the solvent through vaporization and to improve operation efficiency, the pressure is preferably equal to or greater than −0.05 MPa with respect to atmospheric pressure. On the other hand, if the pressure is higher than atmospheric pressure, air between the layers is not pushed out, and entry of the resin between the layers is easily prevented.

A winding is wound directly or with a core case after insertion into a core case around the wound magnetic core with the resin impregnated. In a case in which the winding is wound directly around the wound magnetic core, insulation may become insufficient if scratching occurs in an electric line due to an edge of the wound magnetic core after the impregnation or the edge of the wound magnetic core after the impregnation is not sufficiently covered with the resin. There is a probability of this leading to a serious accident such as a fire. Such a problem can be solved by winding the winding after the wound magnetic core is inserted into the core case.

The wound magnetic core according to the invention is preferably used for a common mode choke coil. In particular, a wound magnetic core for a common mode choke coil used in a vehicle is required to have impact resistance and vibration resistance. The wound magnetic core according to the invention has excellent reliability since the resin is easily impregnated even at a part where the degree of curvature is high and breakage or peeling of the thin strip hardly occurs.

Although the invention will be described in further detail below, the invention is not limited thereto.

Examples

First, a soft magnetic alloy thin strip that can undergo nano-crystallization was wound, thereby preparing a circular multilayer body 1' as illustrated in FIG. 5.

As the soft magnetic alloy thin strip that can undergo nano-crystallization, a soft magnetic alloy thin strip with a composition of $Fe_{bal}Cu_1Nb_{2.5}Si_{13.5}B_7$ (at %) with a width of 40 mm and a thickness of 14 μm was used.

The multilayer body 1' was obtained by winding the soft magnetic alloy thin strip that can undergo nano-crystallization around a cylindrical bobbin with an outer diameter of 63 mm such that the outer diameter became 117 mm, the inner diameter became 113 mm, the height became 40 mm, the thickness in the lamination direction became 4 mm, and the space factor became 75%. Note that in the specification, the respective diagrams are for schematically explaining the shapes, and the dimensions may be appropriately changed.

Figure 6A:
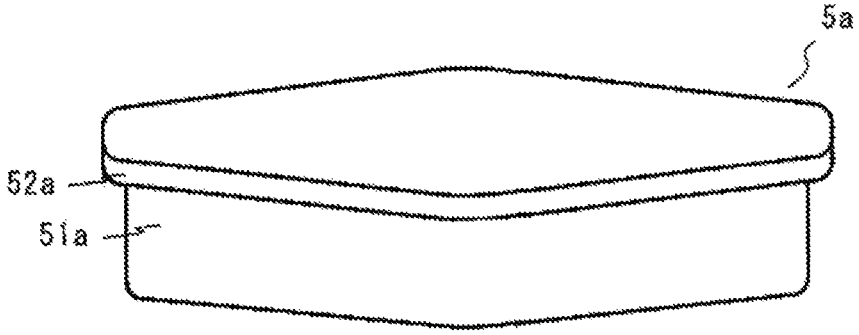
FIG. 6(*a*) and FIG. 6(*b*) are perspective views illustrating an example of a heat treatment inner peripheral jig 5*a*.
Figure 6B:
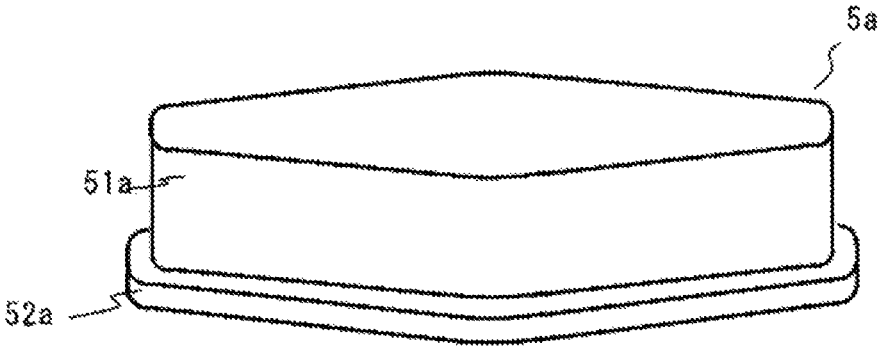

Next, the multilayer body 1' was deformed into a flat shape using an inner peripheral jig illustrated in FIG. 6(*a*) and FIG. 6(*b*). In the embodiment, a ratio between a maximum diameter and a minimum diameter of a multilayer body 1*a* deformed into a flat shape was 3.

FIG. 6(*a*) is a perspective view of a heat treatment inner peripheral jig 5*a*. FIG. 6(*b*) is a perspective view from another angle. The inner peripheral jig 5*a* included a contact surface 51*a* formed to be brought into contact with an inner peripheral surface of the multilayer body and hold the multilayer body in a desired shape. Also, the inner peripheral jig 5*a* included a flange 52*a* formed to abut on an end of the multilayer body 1' in the axial direction in the embodiment.

In the embodiment in which the inner peripheral jig 5*a* was used, the contact surface 51*a* was inserted on an inner peripheral side of the multilayer body 1' while the multilayer body 1' was formed into a flat shape, and the multilayer body 1' was deformed into a desired non-circular shape along a peripheral side surface of the contact surface 51*a*.

Figure 7:
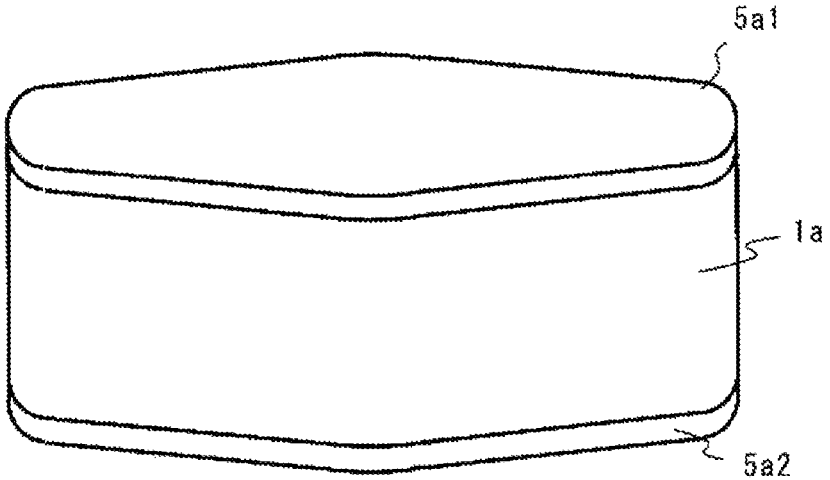
FIG. 7 is a perspective view illustrating an example of a state in which the multilayer body 1*a* and inner peripheral jigs 5*a*1 and 5*a*2 are combined when nano-crystallization is performed.

FIG. 7 is a perspective view illustrating a state in which inner peripheral jigs 5*a*1 and 5*a*2 were inserted into the multilayer body 1'. The inner peripheral jigs 5*a*1 and 5*a*2 had the same shape and were inserted on the inner peripheral side of the multilayer body 1' from both sides. The contact surface 51*a* of the inner peripheral jig 5*a* has a shape in contact with the entire periphery of the inner peripheral surface of the multilayer body 1'. In this manner, the inner peripheral jig 5*a* maintains the entire inner peripheral surface of the multilayer body 1' in a desired non-circular shape.

Figure 8A:
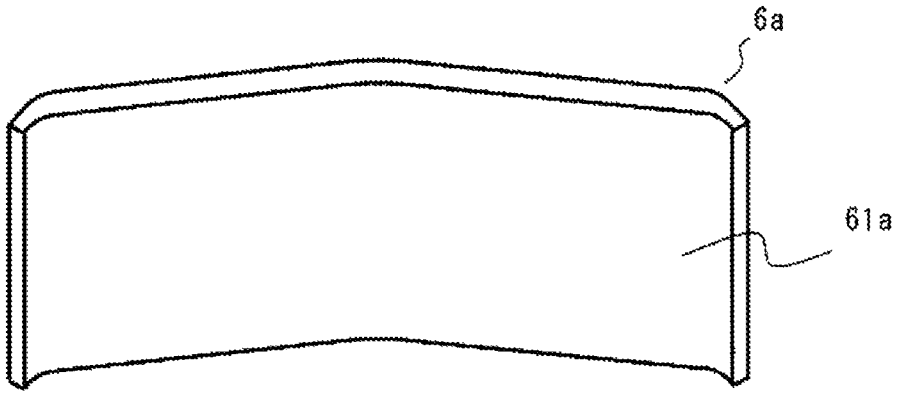
FIG. 8(*a*) and FIG. 8(*b*) are perspective views illustrating an example of a heat treatment outer peripheral jig 6*a*.
Figure 8B:
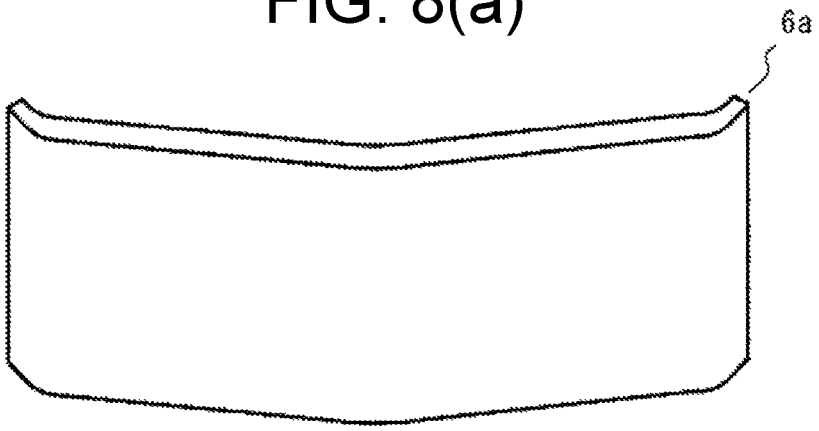

Note that it is possible to use an outer peripheral jig 6*a* as illustrated in FIG. 8(*a*) and FIG. 8(*b*) in addition to the inner peripheral jig 5*a* when the multilayer body 1' is formed into the non-circular shape. Hereinafter, a manufacturing process when an outer peripheral jig is used will be described.

FIG. 8(*a*) is a perspective view of the heat treatment outer peripheral jig 6*a*. FIG. 8(*b*) is a perspective view of the outer peripheral jig 6*a* from another angle. The outer peripheral jig 6*a* included a contact surface 61*a* formed for being brought into contact with an outer peripheral surface of the multilayer body to maintain the multilayer body in a desired non-circular shape. Two outer peripheral jigs 6*a* (outer peripheral jigs 6*a*1 and 6*a*2) were used to cause the contact surface 61*a* of the outer peripheral jigs 6*a*1 and 6*a*2 to abut the multilayer body 1'. Thereafter, the distance between the outer peripheral jigs 6*a*1 and 6*a*2 was gradually narrowed, and the multilayer body 1' was deformed into a shape that followed the contact surface 61*a*. Thereafter, the inner peripheral jig 5*a* in FIG. 6(*a*) and FIG. 6(*b*) was inserted into the multilayer body 1' that is deformed into the non-circular shape.

Figure 9:
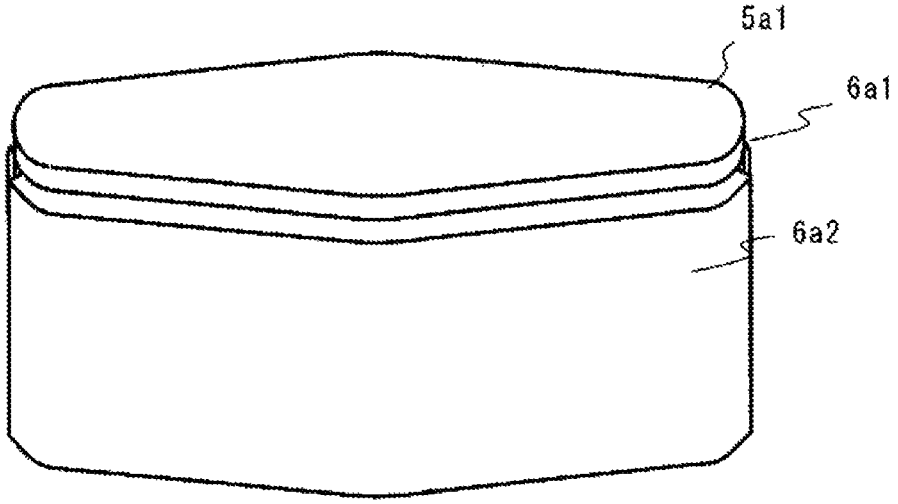
FIG. 9 is a perspective view illustrating an example of a state in which the inner peripheral jig Sal (5*a*2 is not illustrated) and outer peripheral jigs 6a1 and 6a2 are combined when nano-crystallization is caused.

FIG. 9 illustrates a state in which the outer peripheral jigs 6*a*1 and 6*a*2 are further used in comparison with the state in FIG. 7. The multilayer body 1' was maintained in the non-circular shape with the inner peripheral jigs 5*a*1 and 5*a*2 and the outer peripheral jigs 6*a*1 and 6*a*2.

A heat treatment for nano-crystallization was performed on the multilayer body 1' in the state of FIG. 7 or FIG. 9. As the heat treatment for nano-crystallization, a means for heating the multilayer body 1' in a nitrogen atmosphere at 580° C. for 1 hour was employed. However, the invention is not limited to the embodiment, and the heat treatment may also be performed in a magnetic field.

Figure 2:
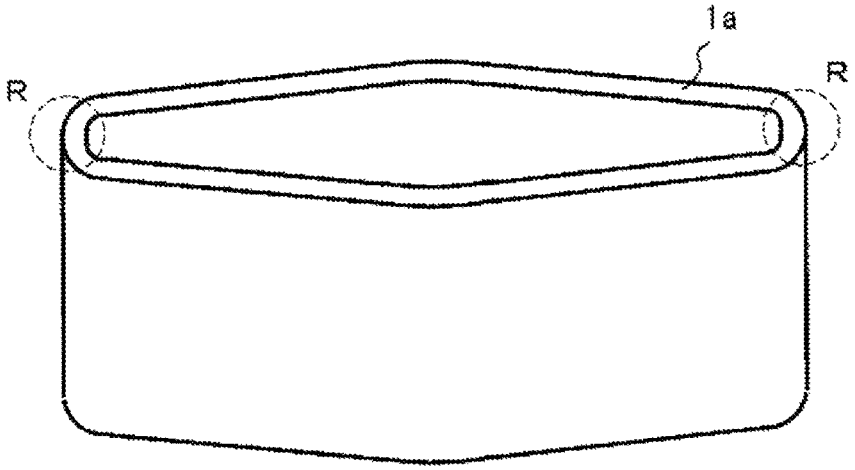
FIG. 2 is a perspective view of a multilayer body 1*a* after nano-crystallization.

Since elasticity of the thin strip after nano-crystallization decreased, the multilayer body 1*a* was not deformed and was maintained in the non-circular shape as illustrated in FIG. 2 even when the inner peripheral jigs and the outer peripheral jigs were removed. Note that in the embodiment, the part R represented by the circle of the dashed line in FIG. 2 corresponded to the part where the non-circular multilayer body had a large degree of curvature.

Note that in the embodiment, the curvature radius on the inner peripheral surface side of the part where the multilayer body 1*a* had the maximum degree of curvature was 7 mm and the maximum degree of curvature was about 0.14 (=1/7 mm) in both cases.

After the nano-crystallization process, a resin impregnation process was performed.

Resin impregnation inner peripheral and outer peripheral jigs were disposed on the multilayer body 1*a* in FIG. 2. In this manner, the multilayer body 1*a* was maintained in the non-circular shape, and these jigs were brought into a state in which the inner peripheral jig and the outer peripheral jig were not in contact with at least one of the inner peripheral surface and the outer peripheral surface of the multilayer body at the part where the multilayer body had a large degree of curvature. Detailed description will be given below.

Figure 3:
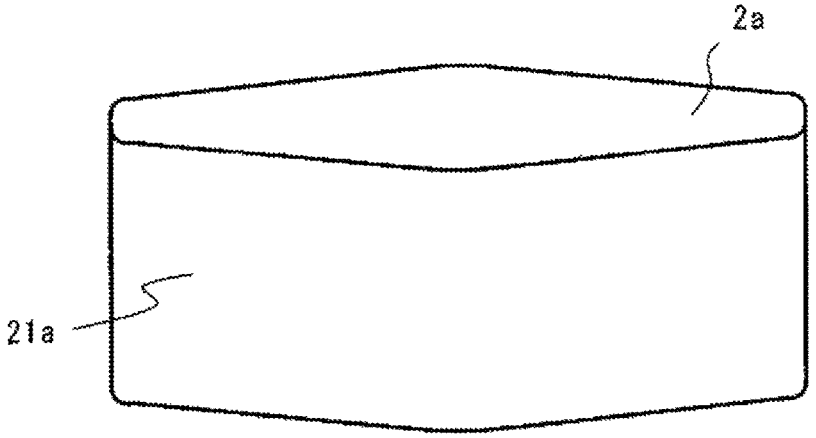
FIG. 3 is a perspective view illustrating an example of the resin impregnation inner peripheral jig 2*a*.

FIG. 3 is a diagram illustrating the resin impregnation inner peripheral jig 2*a* used in the embodiment. The inner peripheral jig 2*a* was shaped to contact the inner peripheral surface of the multilayer body at the part where the multilayer body had the large degree of curvature, and in the embodiment, the inner peripheral jig 2*a* had a contact surface 21*a* for maintaining the entire periphery of the internal peripheral surface of the multilayer body. Note that the contact surface 21*a* in the embodiment had the same shape as the upper and lower contact surfaces 51*a* in a state in which the heat treatment inner peripheral jigs 5*a*1 and 5*a*2 abutted.

Figure 4A:
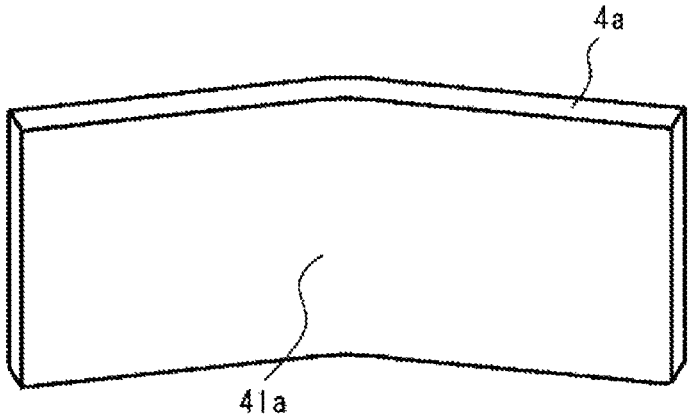
FIG. 4(*a*) and FIG. 4(*b*) are perspective views illustrating the resin impregnation outer peripheral jig 4*a*.
Figure 4B:
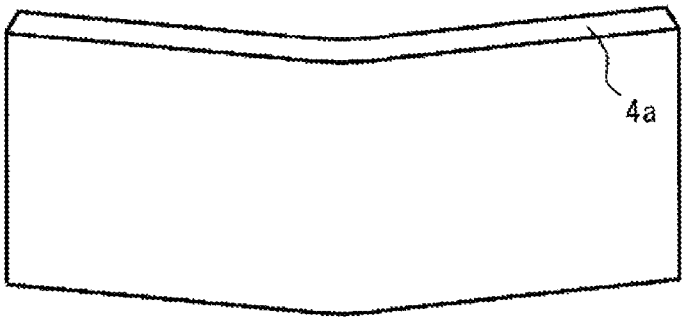

FIG. 4(*a*) and FIG. 4(*b*) are diagrams illustrating a resin impregnation outer peripheral jig 4*a* used in the embodiment. FIG. 4(*a*) is a perspective view of the resin impregnation outer peripheral jig 4*a*. FIG. 4(*b*) is a perspective view of the outer peripheral jig 4*a* from another angle. The outer peripheral jig 4*a* was shaped so as to not contact the outer peripheral surface of the multilayer body at the part where the multilayer body had a large degree of curvature while being in contact with at least a part of the outer peripheral surface of the multilayer body to maintain the multilayer body in the non-circular shape. The resin impregnation outer peripheral jig 4*a* had a contact surface 41*a* that was brought into contact with the outer peripheral surface of the multilayer body to maintain the desired non-circular shape.

FIG. 1 illustrates a state in which two jigs, namely the inner peripheral jig 2*a* in FIG. 3 and the outer peripheral jig 4*a* in FIG. 4(*a*) and FIG. 4(*b*), are disposed on the multilayer body 1*a* in FIG. 2.

In this state, the inner peripheral surface of the multilayer body 1*a* was maintained with the inner peripheral jig 2*a* at the part where the degree of curvature was large while the outer peripheral surface thereof was not in contact with the outer peripheral jigs 4*a*1 and 4*a*2.

Resin impregnation was performed on the multilayer body 1*a* in the state in FIG. 1.

In the embodiment, an epoxy resin was used, and the viscosity of the used epoxy resin was adjusted to 0.5 mPa·s by diluting it with an organic solvent (acetone). The multilayer body was dipped into the diluted epoxy resin, thereby impregnating the resin. A pressure applied when the resin was impregnated was set to be atmospheric pressure. After the resin was impregnated, heat was applied, and the resin was thus caused to be cured.

Since the thicknesses of resin adhering during the resin impregnation differed at a part in contact with the jigs and a part that was not in contact with the jigs in the obtained wound magnetic core, a boundary between both the parts was able to be visually recognized. Therefore, it is possible to refer to whether or not there is such a boundary when it is determined whether or not the invention is suitable for each case.

Note that the wound magnetic core obtained in the embodiment exhibited a high inductance value in comparison with a wound magnetic core manufactured by holding both the inner peripheral surface and the outer peripheral surface with the resin impregnation inner peripheral jig and the outer peripheral jig at the part where the multilayer body had a large degree of curvature.

Note that the inductance was measured with an LCR meter under conditions of 100 kHz and 0.5 A/m.

Figure 10:
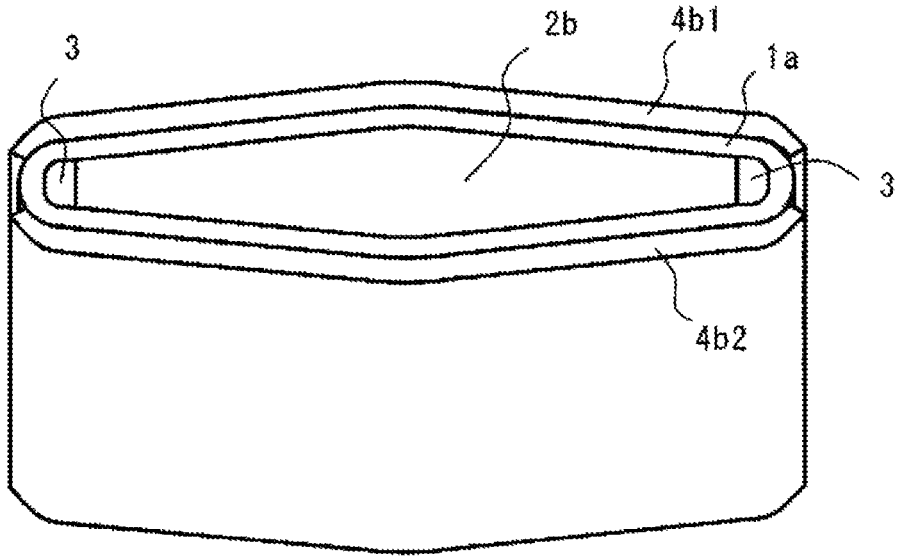
FIG. 10 is a diagram illustrating an example of a state in which the multilayer body 1*a*, the inner peripheral jig 2*b*, and the outer peripheral jigs 4*b*1 and 4*b*2 are combined in another embodiment when a resin is impregnated.

FIG. 10 is a diagram illustrating an embodiment in which the shape of the multilayer body 1*a* is the same as that in FIG. 2 while the resin impregnation jigs have parts that are brought into contact with neither the inner peripheral surface nor the outer peripheral surface of the multilayer body at the part where the multilayer body has the large degree of curvature.

Processes before and during the nano-crystallization process were performed similarly to those described above. After the nano-crystallization process, a resin impregnation process was performed.

Resin impregnation inner peripheral jig 2*b* and outer peripheral jigs 4*b*1 and 4*b*2 were disposed on the multilayer body 1*a* in FIG. 2. In this manner, the multilayer body 1*a* was maintained in the non-circular shape, and these jigs were brought into a state in which the jigs were in contact with neither the inner peripheral surface nor the outer peripheral surface at the part where the multilayer body had a large degree of curvature. Detailed description will be given below.

Figure 11:
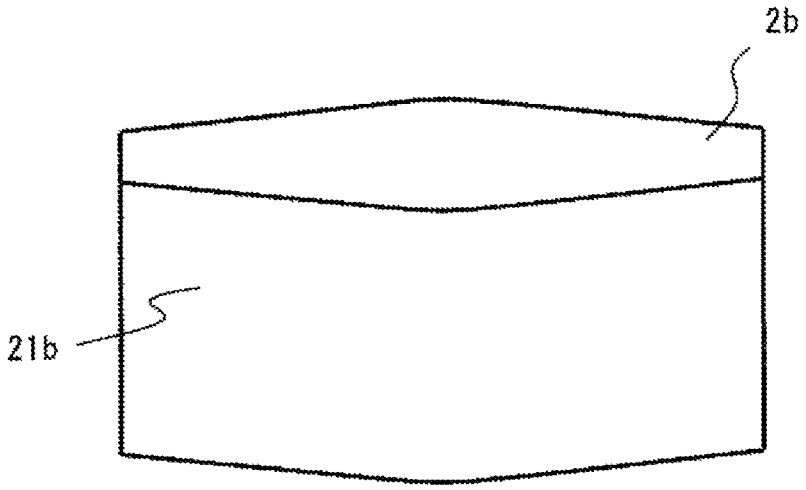
FIG. 11 is a perspective view of the inner peripheral jig 2*b* used in FIG. 10.

FIG. 11 is a diagram illustrating the resin impregnation inner peripheral jig 2*b* used in the embodiment. The inner peripheral jig 2*b* had a contact surface 21*b* that was not brought into contact with the inner peripheral surface of the multilayer body at the part where the degree of curvature was large while being brought into contact with at least a part of the inner peripheral surface of the multilayer body to maintain the multilayer body in a non-circular shape.

As the resin impregnation outer peripheral jig, an outer peripheral jig with the same shape as the heat treatment outer peripheral jig illustrated in FIG. 8(*a*) and FIG. 8(*b*) was used (not illustrated). The outer peripheral jig was shaped so as to not contact the outer peripheral surface of the multilayer body at the part where the degree of curvature was large while being brought into contact with at least a part of the outer peripheral surface of the multilayer body to maintain the multilayer body in a non-circular shape.

FIG. 10 is a diagram illustrating a state in which the inner peripheral jig 2*b* in FIG. 11 and two outer peripheral jigs (4*b*1 and 4*b*2) with the same shape as in FIG. 8(*a*) and FIG. 8(*b*) are disposed on the multilayer body 1*a* in FIG. 2.

In this state, the multilayer body 1*a* was adapted such that the inner peripheral surface of the multilayer body was not brought into contact with the inner peripheral jig 2*b* at the part where the degree of curvature was large. In addition, the outer peripheral surface of the multilayer body was partially maintained while the part where the degree of curvature was large included a part that was not brought into contact with the outer peripheral jigs 4b1 and 4b2.

Inductance of the manufactured wound magnetic core was a value that was able to be applied to practical use similarly to other embodiments described above even when the resin impregnation jigs according to the embodiment were used.

Figure 12:
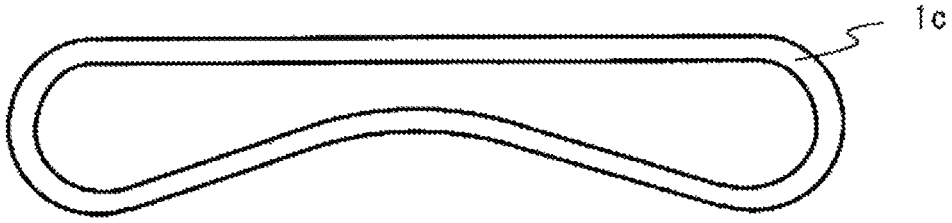
FIG. 12 is a plan view of a multilayer body 1*c* according to another embodiment when viewed in an axial direction.

FIG. 12 illustrates the shape of a multilayer body 1c according to another embodiment. Note that the multilayer body in FIG. 12 is a non-circular multilayer body when viewed in the axial direction. In the embodiment, the multilayer body 1c had a flat shape with at least a part that is recessed inward. Note that the curvature radius of the part where the degree of curvature was maximum was 20 mm, and the maximum degree of curvature was about 0.05 (=1/20 mm). Also, a ratio between the maximum diameter (the diameter in the horizontal direction in the drawing) and the minimum diameter (the diameter in the vertical direction in the drawing) was 4.8.

Figure 14:
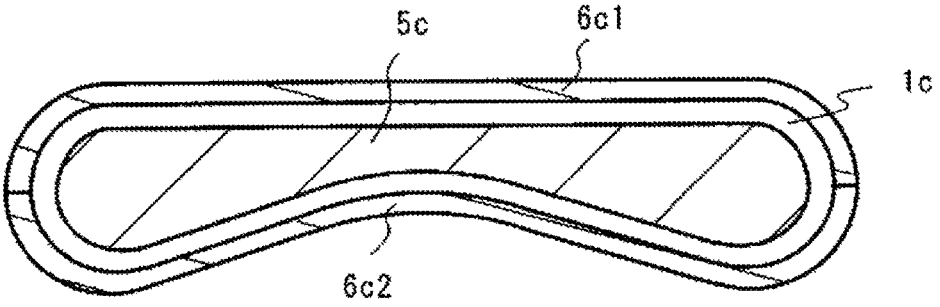
FIG. 14 is a diagram illustrating an example of a state of the multilayer body 1*c*, an inner peripheral jig 5*c*, and outer peripheral jigs 6*c*1 and 6*c*2 in another embodiment during nano-crystallization.

FIG. 14 is a diagram illustrating a state in which the shape of the multilayer body 1c is maintained with heat treatment outer peripheral jigs 6c1 and 6c2 and an inner peripheral jig 5c. Heat treatment for nano-crystallization was performed on the multilayer body 1c in this state. The inner peripheral jig 5c was shaped to contact the entire inner peripheral surface of the multilayer body 1c. Also, the outer peripheral jigs 6c1 and 6c2 were also shaped to contact the entire outer peripheral surface of the multilayer body 1c in a state in which both the jigs were combined in the embodiment.

Figure 13:
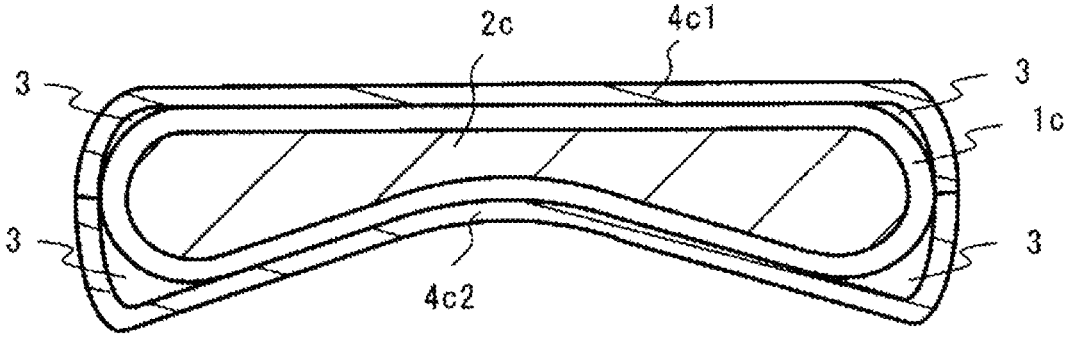
FIG. 13 is a diagram illustrating an example of a state in which the multilayer body 1*c*, an inner peripheral jig 2*c*, and outer peripheral jigs 4*c*1 and 4*c*2 are combined in another embodiment when a resin is impregnated.

FIG. 13 is a diagram illustrating a state in which the shape of the multilayer body 1c is maintained with the resin impregnation outer peripheral jigs 4c1 and 4c2 and inner peripheral jig 2c. Resin impregnation was performed on the multilayer body 1c in this state. The inner peripheral jig 2c was shaped to contact the inner peripheral surface of the multilayer body at the part where the multilayer body 1c had a large degree of curvature. In the embodiment, the inner peripheral jig 2c was shaped to contact the entire inner peripheral surface of the multilayer body. Meanwhile, the outer peripheral jigs 4c1 and 4c2 were shaped so as to not contact the outer peripheral surface of the multilayer body at the part where the degree of curvature was large while being brought into contact with at least a part of the outer peripheral surface of the multilayer body 1c to maintain the multilayer body 1c in the non-circular shape. In the embodiment, the outer peripheral jigs 4c1 and 4c2 were brought into partial contact with the outer peripheral surface at the part where the multilayer body had a large degree of curvature while most parts of the outer peripheral jigs 4c1 and 4c2 were not in contact with the outer peripheral surface, and a space 3 was present on an outer peripheral side of the part where the multilayer body had a large degree of curvature.

Note that substances and methods similar to those described above can be employed as the alloy thin strip, the method of the heat treatment for nano-crystallization, the method of the resin impregnation, and the like. The wound magnetic core according to the embodiment had a height of 40 mm and a thickness of 4 mm in the lamination direction.

Inductance of the manufactured wound magnetic core was a value that was able to be applied to practical use similarly to other embodiments described above even when the resin impregnation jigs according to the embodiment were used.

Figure 15:
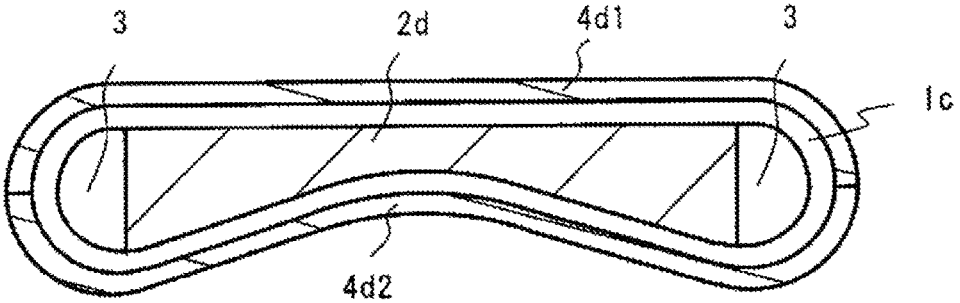
FIG. 15 is a diagram illustrating an example of a state in which the multilayer body 1*c*, an inner peripheral jig 2*d*, and outer peripheral jigs 4*d*1 and 4*d*2 are combined in another embodiment when a resin is impregnated.

FIG. 15 illustrates an embodiment in which the shape of the multilayer body is the same as that in FIG. 12 while shapes of resin impregnation jigs are different. Resin impregnation outer peripheral jigs 4d1 and 4d2 were shaped to contact the outer peripheral surface of the multilayer body 1c at the part where the multilayer body 1c had a large degree of curvature. Meanwhile, the resin impregnation inner peripheral jig 2d was shaped so as to not contact the inner peripheral surface of the multilayer body at the part where the degree of curvature was large while being brought into contact with at least a part of the inner peripheral surface of the multilayer body 1c to maintain the multilayer body 1c in the non-circular shape.

Note that the outer peripheral jigs 4d1 and 4d2 were shaped to maintain the entire periphery of the outer peripheral surface of the multilayer body 1c in the embodiment. The space 3 was present on the inner peripheral surface side of the part where the multilayer body 1c had a large degree of curvature.

The resin was impregnated in the multilayer body 1c in this state.

Inductance of the manufactured wound magnetic core was a value that was able to be applied to practical use similarly to other embodiments described above even when the resin impregnation jigs according to the embodiment were used.

Figure 16:
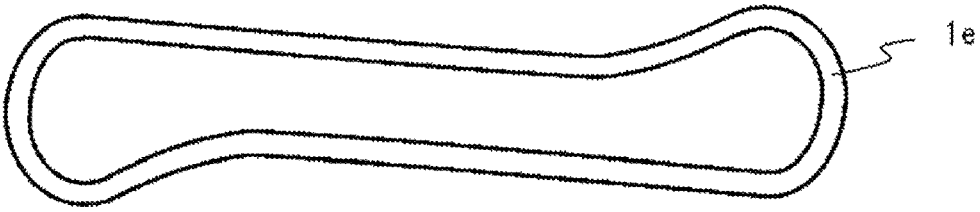
FIG. 16 is a plan view of a multilayer body 1*e* in another embodiment when viewed in the axial direction.

FIG. 16 illustrates a shape of a multilayer body according to another embodiment. Note that the multilayer body 1e in FIG. 16 was a non-circular multilayer body when viewed in the axial direction. In the embodiment, the multilayer body 1e had a flat shape with at least a part that is recessed inward. Note that the curvature radius at the part where the degree of curvature reached the maximum was 20 mm and the maximum degree of curvature was about 0.05 (=1/20 mm). Also, a ratio between the maximum diameter (the diameter in the horizontal direction in the drawing) and the minimum diameter (the diameter in the vertical direction in the drawing) was 4.4.

Figure 18:
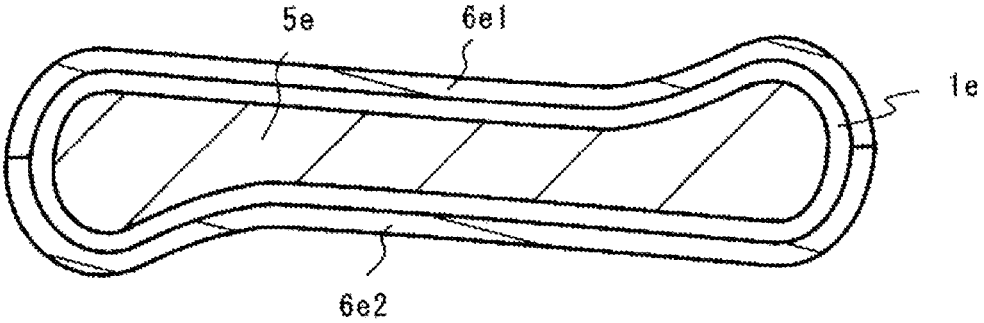
FIG. 18 is a diagram illustrating an example of a state in which the multilayer body 1*e*, an inner peripheral jig 5*e*, and outer peripheral jigs 6*e*1 and 6*e*2 are combined in another embodiment during nano-crystallization.

FIG. 18 is a diagram illustrating a state in which the shape of the multilayer body 1e is maintained with outer peripheral jigs 6e1 and 6e2 and an inner peripheral jig 5e for heat treatment. Heat treatment for nano-crystallization was performed on the multilayer body 1e in this state. The inner peripheral jig 5e was shaped to contact the entire inner peripheral surface of the multilayer body 1e. Also, the outer peripheral jigs 6e1 and 6e2 were also shaped to contact the entire outer peripheral surface of the multilayer body 1e in which both jigs were combined in the embodiment.

Figure 17:
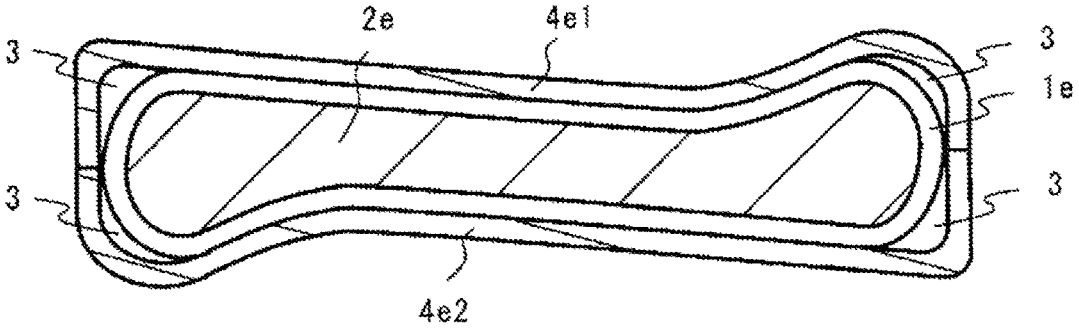
FIG. 17 is a diagram illustrating an example of a state in which the multilayer body 1*e*, an inner peripheral jig 2*e*, and outer peripheral jigs 4*e*1 and 4*e*2 are combined in another embodiment when a resin is impregnated.

FIG. 17 is a diagram illustrating a state in which the shape of the multilayer body 1e was maintained with resin impregnation outer peripheral jigs 4e1 and 4e2 and inner peripheral jig 2e. Resin impregnation was performed on the multilayer body 1e in this state. The inner peripheral jig 2e was shaped to contact the inner peripheral surface of the multilayer body at the part where the multilayer body 1e had a large degree of curvature, and the outer peripheral jigs 4e1 and 4e2 were shaped so as to not contact the outer peripheral surface of the multilayer body at the part where the multilayer body had a large degree of curvature while being brought into contact with at least a part of the outer peripheral surface of the multilayer body to maintain the multilayer body in a non-circular shape. In the embodiment, the outer peripheral jigs 4e1 and 4e2 were brought into partial contact with the outer peripheral surface at the part where the multilayer body had a large degree of curvature while most parts of the outer peripheral jigs 4e1 and 4e2 were not in contact with the outer peripheral surface. Also, the space 3 was present on an outer peripheral side of the part where the multilayer body 1e had a large degree of curvature.

Note that substances and methods similar to those described above can be employed as the alloy thin strip, the method of the heat treatment for nano-crystallization, the method of the resin impregnation, and the like. The wound magnetic core according to the embodiment had a height of 40 mm and a thickness of 4 mm in the lamination direction.

Inductance of the manufactured wound magnetic core was a value that was able to be applied to practical use similarly to other embodiments described above even when the resin impregnation jigs according to the embodiment were used.

Figure 19:
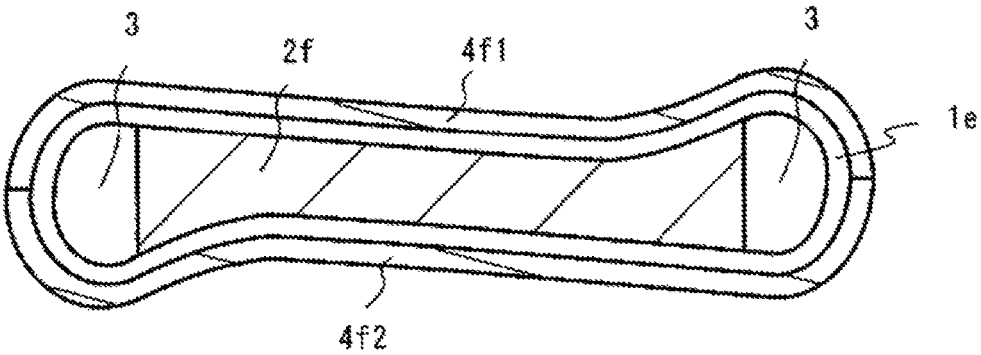
FIG. 19 is a diagram illustrating an example of a state in which the multilayer body 1*e*, an inner peripheral jig 2*f*, and outer peripheral jigs 4*f*1 and 4*f*2 are combined in another embodiment when a resin is impregnated.

FIG. 19 illustrates an embodiment in which the shape of the multilayer body is the same as that in FIG. 16 while shapes of resin impregnation jigs are different. Resin impregnation outer peripheral jigs 4*f*1 and 4*f*2 were shaped to contact the outer peripheral surface of the multilayer body at a part where a multilayer body 1*e* had a large degree of curvature. Meanwhile, a resin impregnation inner peripheral jig 2*f* was shaped to contact the inner peripheral surface of the multilayer body 1*e* to maintain the multilayer body in a non-circular shape, but does not contact the inner peripheral surface of the multilayer body at the part where the multilayer body had a large degree of curvature.

Note that the outer jigs 4*f*1 and 4*f*2 were shaped to maintain the entire periphery of the outer peripheral surface of the multilayer body 1*e* in the embodiment. The space 3 was present on the inner peripheral surface side of the part where the multilayer body 1*e* had a large degree of curvature.

The resin was impregnated in the multilayer body 1*e* in this state.

Inductance of the manufactured wound magnetic core was a value that was able to be applied to practical use similarly to other embodiments described above even when the resin impregnation jigs according to the embodiment were used.

Figure 20:
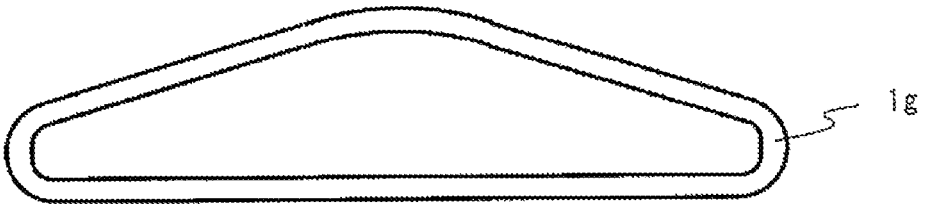
FIG. 20 is a plan view of a multilayer body 1*g* in another embodiment when viewed in the axial direction.

FIG. 20 illustrates a shape of a multilayer body 1*g* according to another embodiment. Note that the multilayer body in FIG. 20 was a non-circular multilayer body when viewed in the axial direction. In the embodiment, the multilayer body 1*g* had a flat shape of substantially an isosceles triangle. Note that the curvature radius of the part where the degree of curvature reached the maximum was 10 mm, and the maximum degree of curvature was about 0.1 (=1/5/5 mm). Also, a ratio between the maximum diameter (the diameter in the horizontal direction in the drawing) and the minimum diameter (the diameter in the vertical direction in the drawing) was 5.

Figure 22:
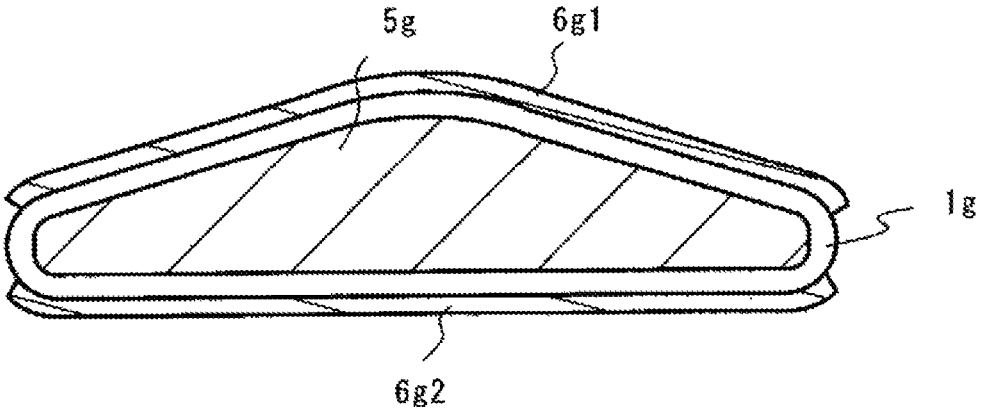
FIG. 22 is a diagram illustrating an example of a state in which the multilayer body 1*g*, an inner peripheral jig 5*g*, and outer peripheral jigs 6*g*1 and 6*g*2 are combined in another embodiment during nano-crystallization.

FIG. 22 is a diagram illustrating a state in which the shape of the multilayer body 1*g* is maintained with outer peripheral jigs 6*g*1 and 6*g*2 and an inner peripheral jig 5*g* for heat treatment. Heat treatment for nano-crystallization was performed on the multilayer body 1*g* in this state. The inner peripheral jig 5*g* was shaped to contact the entire inner peripheral surface of the multilayer body 1*g*. Also, the outer peripheral jigs 6*g*1 and 6*g*2 were shaped to contact the outer peripheral surface of the multilayer body 1*g* other than the part where the multilayer body 1*g* had a large degree of curvature.

Figure 21:
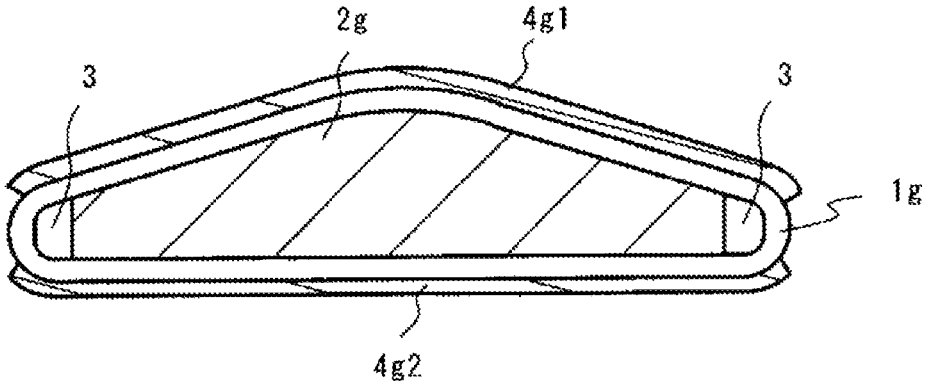
FIG. 21 is a diagram illustrating an example of a state in which the multilayer body 1*g*, an inner peripheral jig 2*g*, and outer peripheral jigs 4*g*1 and 4*g*2 are combined in another embodiment when a resin is impregnated.

FIG. 21 is a diagram illustrating a state in which the shape of the multilayer body 1*g* is maintained with resin impregnation outer peripheral jigs 4*g*1 and 4*g*2 and inner peripheral jig 2*g*. Resin was impregnated in the multilayer body 1*g* in this state. In this manner, the multilayer body 1*g* was maintained in a non-circular shape, and these jigs were brought into contact with neither the inner peripheral surface nor the outer peripheral surface of the multilayer body at the part where the multilayer body 1*g* had a large degree of curvature.

In this embodiment, the inner peripheral jig 2*g* was brought into contact with at least a part of the inner peripheral surface of the multilayer body to maintain the multilayer body in a non-circular shape while not being brought into contact with the inner peripheral surface of the multilayer body at the part where the multilayer body had a large degree of curvature. Also, the space 3 was present on the inner peripheral side of the part where the multilayer body 1*g* had a large degree of curvature. In addition, the outer peripheral jigs 4*g*1 and 4*g*2 were brought into partial contact with the outer peripheral surface at the part where the multilayer body had a large degree of curvature on both sides when viewed in the axial direction while most parts of the outer peripheral jigs 4*g*1 and 4*g*2 were not in contact with the outer peripheral surface.

Note that substances and methods similar to those described above can be employed as the alloy thin strip, the method of the heat treatment for nano-crystallization, the method of the resin impregnation, and the like. The wound magnetic core according to the embodiment had a height of 40 mm and a thickness of 4 mm in the lamination direction.

Inductance of the manufactured wound magnetic core was a value that was able to be applied to practical use similarly to other embodiments described above even when the resin impregnation jigs according to the embodiment were used.

The invention claimed is:

1. A method for manufacturing a non-circular wound magnetic core composed of a nano-crystallized soft magnetic alloy strip, the method comprising:

a step of acquiring a multilayer body by winding a soft magnetic alloy strip that can undergo nano-crystallization around a bobbin;

a step of nano-crystallizing the soft magnetic alloy strip that can undergo nano-crystallization by removing the bobbin from the multilayer body, and inserting a heat treatment inner peripheral jig on an inner peripheral side of the multilayer body, maintaining the multilayer body in a non-circular shape when viewed in the axial direction, and subjecting the multilayer body maintained in the non-circular shape to heat treatment; and a step of maintaining the nano-crystallized multilayer body in the non-circular shape using resin impregnation inner peripheral and outer peripheral jigs and impregnating a resin between the layers of the multilayer body, wherein a pressure applied when the resin is impregnated is equal to or greater than −0.05 MPa and equal to or less than 0 MPa with respect to atmospheric pressure, and wherein the resin impregnation inner peripheral and outer peripheral jigs are shaped so as to not contact at least one of the inner peripheral surface and the outer peripheral surface of the multilayer body at a part where the multilayer body has a degree of curvature that is equal to or greater than 0.02, wherein the degree of curvature is calculated based on a reciprocal of a curvature radius R (1/mm).

2. The method for manufacturing the wound magnetic core according to claim 1, wherein the resin impregnation inner peripheral jig is shaped to contact the inner peripheral surface of the multilayer body at the part where the multilayer body has the degree of curvature that is equal to or greater than 0.02, and the resin impregnation outer peripheral jig is shaped to contact at least a part of the outer peripheral surface of the multilayer body to maintain the multilayer body in the non-circular shape, but does not contact the outer peripheral surface of the multilayer body at the part where the multilayer body has the degree of curvature that is equal to or greater than 0.02.

3. The method for manufacturing the wound magnetic core according to claim 2, wherein in the step of acquiring the multilayer body by winding the soft magnetic alloy strip that can undergo nano-crystallization, the obtained multilayer body has a circular shape when viewed in the axial direction and a space factor of the soft magnetic alloy strip is equal to or greater than 70% and equal to or less than 85%.

4. The method for manufacturing the wound magnetic core according to claim 2, wherein the heat treatment inner peripheral jig is shaped to contact the inner peripheral surface of at least the part where the multilayer body has the degree of curvature that is equal to or greater than 0.02.

5. The method for manufacturing the wound magnetic core according to claim 2, wherein, in the step of nano-crystallization the multilayer body is also maintained on an outer peripheral side using a heat treatment outer peripheral jig, and the heat treatment outer peripheral jig is shaped to maintain at least a part of the outer peripheral surface of the multilayer body in the non-circular shape.

6. The method for manufacturing the wound magnetic core according to claim 1, wherein the resin impregnation outer peripheral jig is shaped to contact the outer peripheral surface of the multilayer body at the part where the multilayer body has the degree of curvature that is equal to or greater than 0.02, and the resin impregnation inner peripheral jig is shaped to contact at least a part of the inner peripheral surface of the multilayer body to maintain the multilayer body in the non-circular shape, but does not contact the inner peripheral surface of the multilayer body at the part where the multilayer body has the degree of curvature that is equal to or greater than 0.02.

7. The method for manufacturing the wound magnetic core according to claim 6, wherein in the step of acquiring the multilayer body by winding the soft magnetic alloy strip that can undergo nano-crystallization, the obtained multilayer body has a circular shape when viewed in the axial direction and a space factor of the soft magnetic alloy strip is equal to or greater than 70% and equal to or less than 85%.

8. The method for manufacturing the wound magnetic core according to claim 6, wherein the heat treatment inner peripheral jig is shaped to contact the inner peripheral surface of at least the part where the multilayer body has the degree of curvature that is equal to or greater than 0.02.

9. The method for manufacturing the wound magnetic core according to claim 6, wherein, in the step of nano-crystallization the multilayer body is also maintained on an outer peripheral side using a heat treatment outer peripheral jig, and the heat treatment outer peripheral jig is shaped to maintain at least a part of the outer peripheral surface of the multilayer body in the non-circular shape.

10. The method for manufacturing the wound magnetic core according to claim 1, wherein in the step of acquiring the multilayer body by winding the soft magnetic alloy strip that can undergo nano-crystallization, the obtained multilayer body has a circular shape when viewed in the axial direction and a space factor of the soft magnetic alloy strip is equal to or greater than 70% and equal to or less than 85%.

11. The method for manufacturing the wound magnetic core according to claim 10, wherein the heat treatment inner peripheral jig is shaped to contact the inner peripheral surface of at least the part where the multilayer body has the degree of curvature that is equal to or greater than 0.02.

12. The method for manufacturing the wound magnetic core according to claim 10, wherein, in the step of nano-crystallization the multilayer body is also maintained on an outer peripheral side using a heat treatment outer peripheral jig, and the heat treatment outer peripheral jig is shaped to maintain at least a part of the outer peripheral surface of the multilayer body in the non-circular shape.

13. The method for manufacturing the wound magnetic core according to claim 1, wherein the heat treatment inner peripheral jig is shaped to contact the inner peripheral surface of at least the part where the multilayer body has the degree of curvature that is equal to or greater than 0.02.

14. The method for manufacturing the wound magnetic core according to claim 13, wherein the heat treatment inner peripheral jig is shaped to maintain the entire periphery of the inner peripheral surface of the multilayer body.

15. The method for manufacturing the wound magnetic core according to claim 1, wherein, in the step of nano-crystallization the multilayer body is also maintained on an outer peripheral side using a heat treatment outer peripheral jig, and the heat treatment outer peripheral jig is shaped to maintain at least a part of the outer peripheral surface of the multilayer body in the non-circular shape.

16. The method for manufacturing the wound magnetic core according to claim 1, wherein the non-circular shape is a flat shape.

17. The method for manufacturing the wound magnetic core according to claim 16, wherein the non-circular shape is a flat shape with at least a part that is recessed inward.

18. The method for manufacturing the wound magnetic core according to claim 1, wherein the wound magnetic core is used for a common mode choke coil.

* * * * *